United States Patent [19]

Petersen et al.

[11] Patent Number: 4,597,725

[45] Date of Patent: Jul. 1, 1986

[54] ROTARY PISTON MACHINE WITH PARALLEL INTERNAL AXES

[75] Inventors: Hans C. Petersen; Svend E. Thomsen; Hans L. Hansen, all of Nordborg, Denmark

[73] Assignee: Danfoss A/S, Nordborg, Denmark

[21] Appl. No.: 692,189

[22] Filed: Jan. 17, 1985

Related U.S. Application Data

[63] Continuation of Ser. No. 550,257, Nov. 10, 1983, abandoned.

[30] Foreign Application Priority Data

Nov. 24, 1982 [DE] Fed. Rep. of Germany ..... 3243404

[51] Int. Cl.[4] ..... F01C 21/12; F01C 1/10

[52] U.S. Cl. ..... 418/61 B; 418/186

[58] Field of Search ..... 418/61 B, 186

[56] References Cited

U.S. PATENT DOCUMENTS

| | | | |
|---|---|---|---|
| 211,769 | 1/1879 | Nash | 418/61 B |
| 3,233,524 | 2/1966 | Charlson | 418/61 B |
| 3,385,057 | 5/1968 | Pruvot et al. | 418/61 B X |
| 3,801,239 | 4/1974 | Lossan | 418/61 B |
| 3,825,376 | 7/1974 | Petersen et al. | 418/61 B |
| 3,876,343 | 4/1975 | Giversen | 418/61 B |
| 4,264,288 | 4/1981 | Wusthof et al. | 418/186 X |

*Primary Examiner*—John J. Vrablik
*Assistant Examiner*—Theodore W. Olds
*Attorney, Agent, or Firm*—Wayne B. Easton

[57] ABSTRACT

A ring and star type gear set is disclosed with recessed passages 32 that serve to communicate the fluid chambers about the line of eccentricity.

8 Claims, 3 Drawing Figures

ROTARY PISTON MACHINE WITH PARALLEL INTERNAL AXES

This application is a continuation of 06/550,257 filed Nov. 10, 1983 and now abandoned.

The invention relates to a rotary piston machine with parallel internal axes comprising an externally toothed gear and an internally toothed gear forming compression chambers between each other, turning and planetating relatively to each other and one being fixed to turn with the main shaft, the periphery of one gear having operative sections making contact with the other gear interspersed with inoperative sections making no contact with the other gear, a distributing valve having two sets of control orifices co-operating in at least one plane perpendicular to the gear axes of which the control orifices of the first set are fixed to a first gear, follow each other circumferentially and lead to the compression chambers by way of passages in the gear and of which the control orifices of the second set are fixed to the second gear and lead to the pressure and suction connection, and auxiliary passages on one gear which interconnect the adjacent compression chambers on each side of the line of symmetry extending between the enlarging and reducing compression chambers but do not make a connection across the line of symmetry, wherein in particular the externally toothed gear turns and planetates and carries the control orifices of the first set at its side.

In a known rotary piston machine of this kind (DE-OS 22 40 632), the teeth of the internally toothed gear are formed by five cylindrical rollers whilst the externally toothed gear has four teeth and a trochoidal peripheral surface. This peripheral surface is effective all around for sealing the compression chambers because all the sections successively make contact with the teeth of the internally toothed gear. The internally toothed gear has, between the inwardly directed surfaces of the rollers, larger sections which are inoperative, do not make contact with the other gear. In each region between the teeth, the externally toothed gear comprises the openings of passages leading to a respective control orifice at the side of the gear that is offset by 90°. These four control orifices of the first set lie on a circle about the axis of the externally toothed gear. The second set of control orifices comprises a central bore on the inlet side and five control orifices on the outlet side arranged on a circle concentric therewith. The auxiliary passages are formed as grooves on the tooth flanks of the externally toothed gear. They permit a compression chamber to be filled or emptied through the adjacent chamber if the associated control orifice of the first set is only insufficiently in registry with a control orifice of the second set.

Whenever the associated peripheral section of the externally toothed gear co-operates with a roller of the internally toothed gear, the mouth of the passages constitutes a short-circuit between a compression chamber under pressure and a compression chamber under suction. This short-circuit is maintained for a comparatively long time because the mouth of the passage is always just located in the vicinity of the instantaneous point of rotation. This short-circuit conflicts with the requirements placed on the auxiliary passages and detrimentally influences the output of the machine.

A rotary piston machine with parallel internal axes is also known (DE-AS 21 55 818), in which the teeth of the internally toothed gear are likewise formed by cylinder rollers and the externally toothed gear has a peripheral surface which is effective all around for sealing the compression chambers. In each zone between the teeth, the externally toothed gear has at one side grooves of triangular cross-section which form four control orifices of the first set and co-operate with ten control orifices of the second set which are alternately connected to the pressure and suction sides and are themselves arranged on a trochoidal path in an adjoining end wall which is fixed to the internally toothed gear. In this machine, again, a short-circuit is produced between a compression chamber under pressure and a compression chamber under suction when the mouth of the groove is disposed in the vicinity of a cylinder roller.

A rotary piston machine with parallel internal axes is also known (DE-OS 28 29 417), wherein only the externally toothed gear turns and the internally toothed gear planetates. The control orifices of the first set arranged at one side of the externally toothed gear co-operate in the nature of a rotary side with the control orifices of the second set arranged in the housing. The internally toothed gear has trochoidal teeth and at the outside a guide which permits planetating motion. The teeth of the externally toothed gear are formed by cylinder rollers. Between each two cylinder rollers there opens a groove which at the same time forms a control orifice of the first set. By reason of the external guide of the internally toothed gear, large dimensions are produced for building in purposes.

The invention is based on the problem of providing a rotary piston machine of the aforementioned kind in which the operating accuracy achievable by the auxiliary passages can be utilised without disadvantage.

This problem is solved according to the invention in that the inoperative sections are provided at the periphery of the first gear, that the passages open into the compression chambers in the region of the inoperative sections, and that the auxiliary passages are formed on the second gear.

In this construction, the auxiliary passages and the passages connected to the control orifices of the first set are located on different gears. It is therefore possible to arrange the mouths of the control orifice passages in the inoperative sections of the first gear so that no short-circuits can be produced and it is nevertheless possible with the aid of the auxiliary passages temporarily to release the seal provided between the adjacent compression chambers. On the whole, therefore, one obtains a rotary piston machine which permits unimpeded filling and emptying of the compression chambers because of the auxiliary passages, even though the control orifices fixed to the first gear or applied directly thereto have only an insufficient distributing function, it being simultaneously ensured that the offset of the auxiliary passages and the output of the machine are not detrimentally influenced by short-circuits.

Particular advantages are provided if the control orifices of the first set are each adjacent to an inoperative section and the control orifices of the second set are disposed on a troichoidal path and alternately connected to the pressure and suction connection. The passages between the control orifice and mouth are very short so that the flow resistances in the passages are low. The comparatively poor distributing function of the control orifices thus formed is compensated by the auxiliary passages. Since no short-circuits occur, one obtains a machine with high efficiency.

In particular, the control orifices of the first set should be disposed on a circle of which the radius measured from the axis of the first gear is at least equal to the value m×e, where m is the number of teeth of the other gear and e is the eccentricity between the two gears. In this way, one ensures that the path of movement of the first control orifices does not include loops and therefore as good a distributing function as possible is already achieved with the aid of the control orifices. This permits the auxiliary passages to be kept small.

In particular, the radius should be somewhat larger than the value m×e. This gives the optimum distributing function.

A particularly simple construction is obtained if the control orifices of the first set are formed by grooves in the side of the gear extending up to the inoperative section.

Preferred examples of the invention will now be described in more detail with reference to the drawing, wherein.

Figure 1:
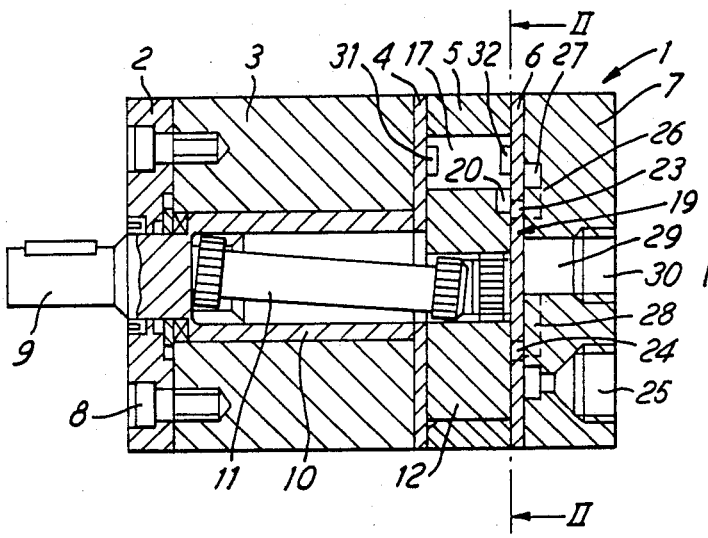
FIG. 1 is a diagrammatic longitudinal section through a rotary piston machine according to the invention.

According to FIG. 1, a fixed housing 1 consists of an end plate 2, a bearing block 3, a side plate 4, an internally toothed gear 5, a further side plate 6 and an end plate 7. These parts are interconnected by screws of which only the screw 8 is illustrated. A main shaft 9 is mounted in the bearing block 3 by means of a sleeve-like extension 10. It is connected by a cardan shaft 11 to an externally toothed gear 12.

Figure 2:
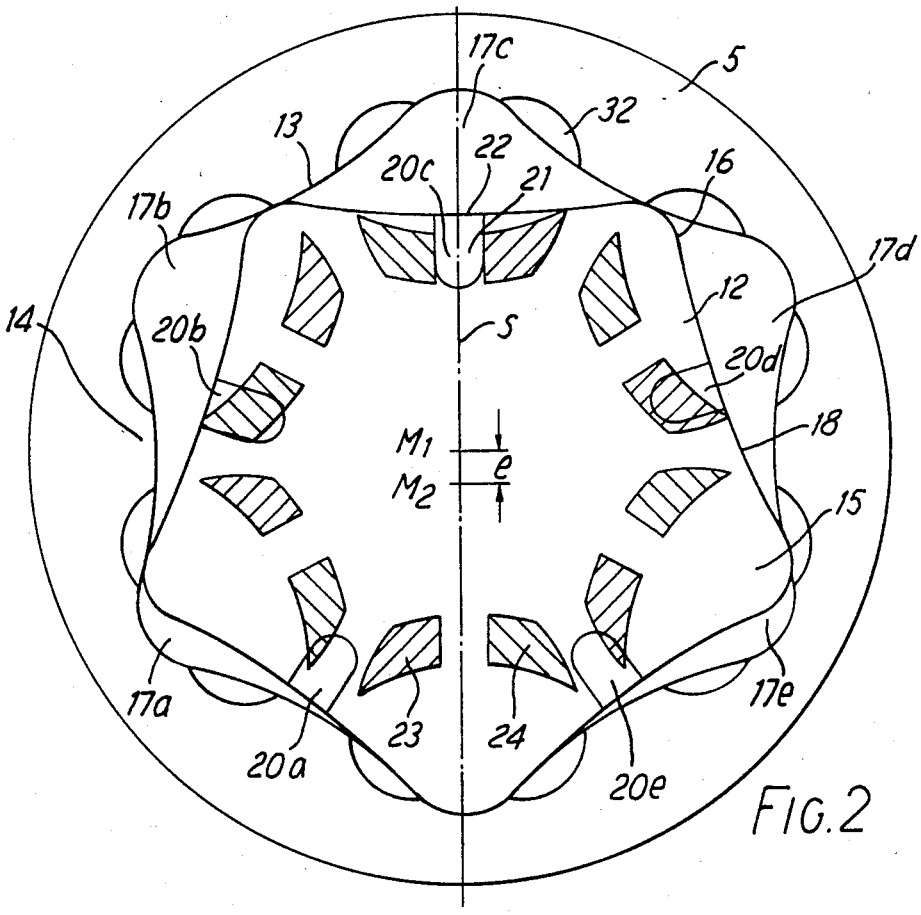
FIG. 2 is an elevation of the gears along the line II—II in FIG. 1 with superposed control orifices of the second set.

As shown in FIG. 2, the internally toothed gear 5 has an inner peripheral surface 13 in the form of a troichoid with the central axis $M_1$. In this way, one obtains six teeth 14. The externally toothed gear 12 with five teeth 15 has a central axis $M_2$ which is eccentric by the distance e with respect to the central axis $M_1$. The teeth 15 have the external shape of a cylinder section which, as an operative peripheral section 16, lies against the peripheral surface 13 so that a total of five compression chambers 17 are formed, namely 17*a* to 17*e*. Between these operative sections 16 there are inoperative sections 18 which make no contact with the internally toothed gear 5.

A distributing valve 19 is formed between the side plate 6 and the adjoining end face of the gear 12. This valve comprises control orifices 20 of a first set in the gear 12 and control orifices 23 and 24 of a second set in the side plate 6. As is shown in FIG. 2, five control orifices 20 are provided, namely the control orifices 20*a* to 20*e* between the teeth 15. They are formed by grooves 21 with a mouth 22 opening towards the periphery. The control orifices 23 and 24 of the second set lie on a trochoidal path about the central axis $M_1$ of gear 5 which is swept by the control orifices 20 during the rotating and planetating motion of the gear 12. The radius of the circle about the central axis $M_2$ on which the control orifices 20 are disposed is somewhat larger than the value m×e, where m is the number of teeth 15, i.e. in this case m=5. The control orifices 23 communicate with a pressure connection 25 in end plate 7 in that they are connected by way of radial passages 26 to an annular groove 27 which, in turn, is connected to the pressure connection 25. The control orifices 24 communicate by way of radial passages 28 and an axial bore 29 with a suction connection 30 which is likewise provided in end plate 7. Different cross-hatching in FIG. 2 shows that the control orifices 23 and 24 are circumferentially alternately connected to the pressure and suction sides.

Auxiliary passages 31 and 32 are provided at both sides of the gear 5 in the flanks of the teeth 14 such that the compression chambers 17*a* and 17*b* on one side are interconnected by the line of symmetry S determined by the central axes $M_1$ and $M_2$, that the compression chambers 17*d* and 17*e* on the other side are also interconnected by the line of symmetry S, but that no connection is made across the line of symmetry. If, for example, the compression chamber 17*e* becomes larger, the replenishment of liquid over the control orifice 20*e* is suppressed because it is in registry with the associated control orifice 23 over only a small area. In addition, the amount of registry changes only slowly because the spacing from the instantaneous centre of rotation of the gear 12 is small. Filling of the compression chamber 17*e* therefore additionally takes place over the auxiliary passages 31 and 32 from the compression chamber 17*d* of which the control orifice 20*d* is in registry with the associated control orifice 23 over a large area.

The auxiliary passages 31 and 32 as well as the control orifices 20 are located on different gears. In addition, the grooves 21 forming the control orifices 20 open within the inoperative sections 18, so that no short-circuit occurs that might otherwise detrimentally influence the control function of the auxiliary passages 31, 32. The rotary piston machine therefore has a very uniform running characteristic, operates with little noise, avoids pressure peaks and has practically no losses in the compression volume.

Figure 3:
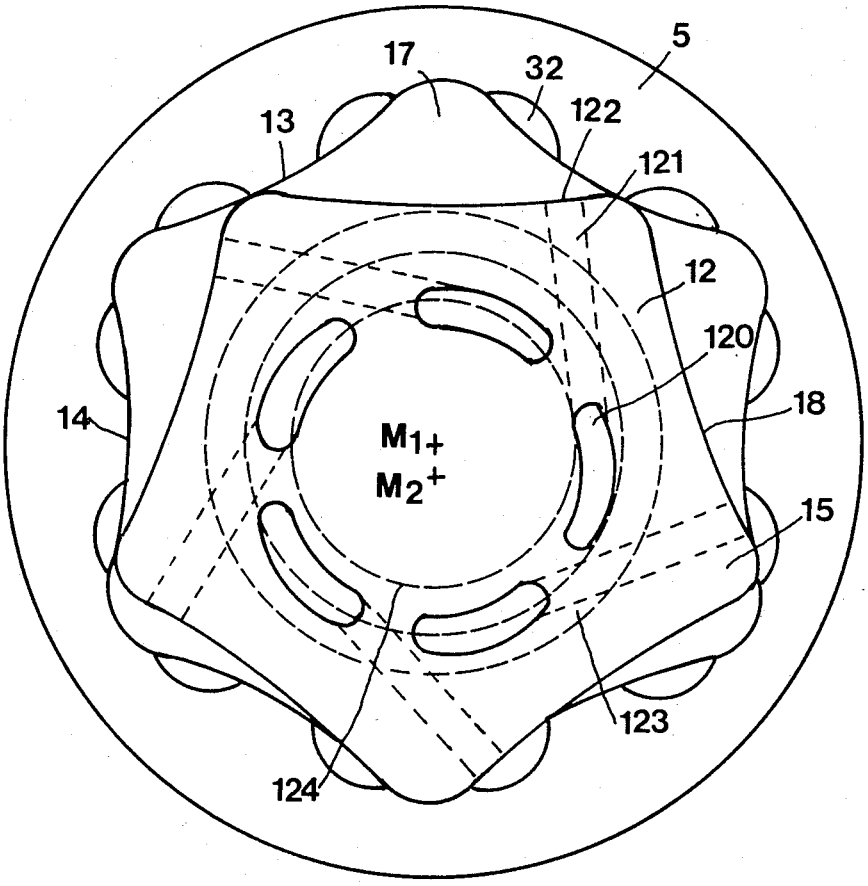
FIG. 3 is a view similar to FIG. 2 of another embodiment.

FIG. 3 illustrates a modified embodiment. In this case, the same reference numerals are used for the same parts and reference numerals increased by 100 for corresponding parts. The difference is that the control orifices 120 of the first set are connected to respective compression chambers 17 offset by 90°, the mouth 122 of the associated passage 121 again being provided in the inoperative section 118 of the periphery of gear 12.

The second set comprises an annular control orifice 123 lying on a circle about the central axis $M_1$ of gear 5 and a control orifice 124 provided as a central bore. By reason of the planetating motion of gear 12, the control orifices 120 come into registry in the correct sense with the control orifices 123 and 124. Here, again, registration over a small area is compensated in that compression chambers can be filled or emptied by way of adjacent compression chambers.

The gears can, for example, consist of individual plates in which the control orifices 20, 120 and any further passages 121 are stamped as recesses and the plates are then connected to form a unit by soldering, welding, adhesion and the like.

It is also possible to interchange the function of the two gears, i.e. to let the external gear 5 rotate and planetate and associate with it the inoperative sections and the first control orifices connected thereto. The second control orifices will then be fixed to the internal gear and are desirably disposed in the surface zone covered by the cross-section of the external gear. The control orifices of the distributing valve can also be provided on both sides of the rotating and planetating gear.

Instead of the annular control orifice 123, a plurality of individual orifices may be provided on the same circle.

We claim:

1. A rotary piston machine comprising, a housing, inlet and outlet passage means, oppositely facing wall means in said housing, meshing externally and internally toothed gerotor type star and ring gears which rotate and gyrate relative to each other and form expanding and collapsing chambers therebetween, said gears being between said wall means in sealing engagement therewith, said gears having parallel axes which define a line of eccentricity with the axis of a moveable one of said gears being gyrateable relative to the axis of the other of said gears, shaft means for turning said moveable gear relative to the other of said gears, means for supplying fluid to and exhausting fluid from said chambers on opposite sides of said line of eccentricity, said ring gear having convexed shaped teeth with bottom sections between said teeth thereof, said star gear having teeth with tooth crests having convex curved sections which mesh in sealing engagement and constant physical contact with said teeth of said ring gear, and said ring gear having at least on one axially facing side thereof recess passages recessed in an axial direction spaced apart on opposite circumferential sides of each of said bottom sections which connect adjacent ones of said chambers only on each side of said line of eccentricity.

2. A rotary piston machine comprising, a housing, inlet and outlet passage means, oppositely facing wall means in said housing, meshing externally and internally toothed gerotor type star and ring gears which rotate and gyrate relative to each other and form expanding and collapsing chambers therebetween, said gears being between said wall means in sealing engagement therewith, said gears having parallel axes which define a line of eccentricity with the axis of a moveable one of said gears being gyrateable relative to the axis of the other of said gears, shaft means for turning said moveable gear relative to the other of said gears, said wall means having inlet and outlet sets of alternately and circumferentially arranged commutating control orifices connected respectively to said inlet and outlet passage means, said moveable gear having a ring of orifices commutatingly cooperable with said inlet and outlet sets of orifices for supplying fluid to and exhausting fluid from said chambers, said ring gear having convexed shaped teeth with bottom sections between said teeth thereof, said star gear having teeth with tooth crests having convex curved sections which mesh in sealing engagement and constant physical contact with said teeth of said ring gear, said ring gear having at least on one axially facing side thereof auxiliary recess passages recessed in an axial direction spaced apart on opposite circumferential sides of each of said bottom sections which connect adjacent ones of said chambers only on each side of said line of eccentricity, said star gear having chamber ports at the periphery thereof indexed so as to be between said tooth crests and having fluid communication with said chambers, and said ring of orifices being respectively connected with said chambers ports.

3. A rotary piston machine according to claim 2 wherein said ring of orifices is arranged on a trochoidal path.

4. A rotary piston machine according to claim 2 wherein said chamber ports lie on a circle of which the radius measured from the axis of said star gear is at least equal to the value $m \times e$, wherein m is the number of teeth of said star gear and e is the eccentricity between said star and ring gear.

5. A rotary piston machine according to claim 4 wherein said radius is somewhat larger than said value $m \times e$.

6. A rotary piston machine according to claim 2 wherein said chamber ports are formed by recesses in the sides of said star teeth.

7. A rotary piston machine comprising, a housing, inlet and outlet passage means, oppositely facing wall means in said housing, meshing externally and internally toothed gerotor type star and ring gears which rotate and gyrate relative to each other and form expanding and collapsing chambers therebetween, said gears being between said wall means in sealing engagement therewith, said gears having parallel axes which define a line of eccentricity with the axis of a moveable one of said gears being gyrateable relative to the axis of the other of said gears, shaft means for turning said moveable gear relative to the other of said gears, fluid supplying and exhausting means connected to said shaft means and said inlet and outlet passage means for synchronously supplying and exhausting fluid to and from said expanding and collapsing chambers, said ring gear having convexed shaped teeth bottom sections between said teeth thereof, said star gear having teeth with tooth crests having convex curved sections which are complementary to said mesh in sealing engagement and constant physical contact with said teeth of said ring gear, and said ring gear having at least on one axially facing side thereof auxiliary recess passages recessed in an axial direction spaced apart on opposite circumferential sides of each of said bottom sections which connect adjacent ones of said chambers only on each side of said line of eccentricity.

8. A rotary piston machine according to claim 7 wherein said fluid supplying and exhausting means commulatively supply fluid to and exhaust fluid from said chambers.

* * * * *